US006407710B2

(12) United States Patent
Keilen et al.

(10) Patent No.: US 6,407,710 B2
(45) Date of Patent: Jun. 18, 2002

(54) COMPACT DUAL FREQUENCY ANTENNA WITH MULTIPLE POLARIZATION

(75) Inventors: Donald Keilen, Sparks, NV (US); Patrick McKivergan, Scotts Valley, CA (US); Matthew Commens, Morgan Hill, CA (US); Robert Hill, Salinas, CA (US)

(73) Assignee: Tyco Electronics Logistics AG (CH)

( * ) Notice: Subject to any disclaimer, the term of this patent is extended or adjusted under 35 U.S.C. 154(b) by 0 days.

(21) Appl. No.: 09/835,659

(22) Filed: Apr. 16, 2001

Related U.S. Application Data

(60) Provisional application No. 60/197,298, filed on Apr. 14, 2000.

(51) Int. Cl.[7] ..... H01Q 1/24
(52) U.S. Cl. ..... 343/702; 343/795; 343/850
(58) Field of Search ..... 343/702, 700 MS, 343/795, 793, 806, 750, 852; H01Q 1/24, 1/38

(56) References Cited

U.S. PATENT DOCUMENTS 6,239,755 B1 * 5/2001 Klemens et al. ..... 343/702
6,239,765 B1 * 5/2001 Johnson et al. ..... 343/795

* cited by examiner

*Primary Examiner*—Hoanganh Le
(74) *Attorney, Agent, or Firm*—Fulbright & Jaworski L.L.P.

(57) ABSTRACT

An asymmetrical dipole antenna is disclosed consisting of a planar conductor, matching network, and resonator. The antenna is compact, may operate on one or more frequency bands, and is suitable for high volume production. The antenna exhibits simultaneous dual linear polarizations and a unidirectional pattern in at least one of its operating frequency ranges when configured for multiple-band operation. Applications for the antenna include wireless communication devices such as cellular telephones or data devices.

23 Claims, 8 Drawing Sheets

S/N: ALCATEL XPOL
CHANNEL: S21
ROTATION: ELEVATION

| FREQ (MHz) | TRACE | BEAM PEAK DEG | BEAM PEAK dB1 |
|---|---|---|---|
| 880.00 | -------- | -7.05 | -.59 |
| 910.00 | -------- | -7.05 | 2.19 |
| 920.00 | -------- | -7.05 | 1.53 |
| 930.00 | -------- | -7.05 | .72 |

| FREQ (MHz) | TRACE | BEAM PEAK DEG | BEAM PEAK dB1 |
|---|---|---|---|
| 960.00 | -------- | -7.05 | -.14 |

S/N: ALCATEL XPOL
CHANNEL: S21
ROTATION: ELEVATION

Tx Po1: HORIZONTAL

| FREQ (MHz) | TRACE | BEAM PEAK DEG | BEAM PEAK dB1 |
|---|---|---|---|
| 1710.00 | -------- | -17.50 | -1.30 |
| 1780.00 | -------- | -17.50 | .95 |
| 1795.00 | -------- | -21.91 | .70 |
| 1810.00 | -------- | -21.91 | .05 |

| FREQ (MHz) | TRACE | BEAM PEAK DEG | BEAM PEAK dB1 |
|---|---|---|---|
| 1880.00 | -------- | -17.50 | 1.41 |

COMPACT DUAL FREQUENCY ANTENNA WITH MULTIPLE POLARIZATION

RELATED APPLICATION

This application claims the benefit of priority pursuant to 35 USC §119(e)(1) from the provisional patent application filed pursuant to 35 USC §111(b): as Ser. No. 60/197,298 on Apr. 14, 2000.

FIELD OF THE INVENTION

The invention relates to antennas and antenna structures for hand-held, portable, or fixed wireless communications devices (WCD), such as cellular telephones, data devices, and GPS receivers. More particularly, the invention relates to an asymmetrical dipole antenna that includes a short planar conductor (ground plane) portion, a resonator portion and a matching network portion. In one embodiment, the antenna is adaptable to fit inside a housing of a WCD for mechanical robustness. An antenna according to the present invention may be used for transmitting, receiving, or for transmitting and receiving.

DESCRIPTION OF RELATED ART

There exists a need for an improved antenna assembly that provides a single and/or dual band response and which can be readily incorporated into a small wireless communications device (WCD). Size restrictions continue to be imposed on the radio components used in products such as portable telephones, personal digital assistants, pagers, etc. For wireless communications devices requiring a dual band response the problem is further complicated. Positioning the antenna assembly within the WCD remains critical to the overall appearance and performance of the device.

Known wireless communications devices such as hand-held cell phones and PCS devices typically are equipped with an external wire antenna (whip), which may be fixed or telescoping. Such antennas are inconvenient and susceptible to damage or breakage. The overall size of the wire antenna is relatively large in order to provide optimum signal characteristics. Furthermore, a dedicated mounting means and location for the wire antenna are required to be fixed relatively early in the engineering process. Several other antenna assemblies are known, including:

Quarter wave straight wire antenna

A quarter wave straight wire antenna is a ¼ wavelength external antenna element, which operates as one side of a half-wave dipole. The other side of the dipole is provided by the ground traces of the transceiver's printed wiring board (PWB). The external ¼ wave element may be installed permanently at the top of the transceiver housing or may be threaded into place. The ¼ wave element may also be telescopically received into the transceiver housing to minimize size. The ¼ wave straight wire adds from 3–6 inches to the overall length of an operating transceiver.

Coiled quarter wave wire antenna

A coiled quarter wave wire antenna has an external small diameter coil that exhibits ¼ wave resonance, and is fed against the ground traces of the transceiver's PWB to form an asymmetric dipole. The coil may be contained in a molded member protruding from the top of the transceiver housing. A telescoping ¼ wave straight wire may also pass through the coil, such that the wire and coil are both connected when the wire is extended, and just the coil is connected when the wire is telescoped down. The transceiver overall length is typically increased by ¾–1 inch by the coil.

Planar Inverted F Antenna (PIFA)

PIFA (Planar Inverted F Antenna) antennas have been used to provide a linear polarization and an omnidirectional pattern in free space, in one plane. A PIFA antenna has an external conducting plate which exhibits ¼ wave resonance, and is fed against the ground traces of the PWB of a transceiver to form an asymmetric dipole. The plate is usually installed on the back panel or side panel of a transceiver and adds to the overall volume of the device.

Patch

Patch antennas have been used to provide either a linear polarization or a circular polarization and a near-hemispherical pattern in free space. An antenna including a planar dielectric material having a resonant structure on one major surface of the dielectric and a second ground plane structure disposed on the opposite major surface. A conductive post may electrically couple (through the dielectric) the resonant structure to a coaxial feedline.

Additionally, there have been numerous efforts in the past to provide an antenna inside a portable radio communication device. Such efforts have sought at least to reduce the need to have an external whip antenna because of the inconvenience of handling and carrying such a unit with the external antenna extended.

Various configurations of driven or driven and parasitic elements located on one side and at one end of a larger planar conductor are known to provide gain proximate that of a dipole (+2.1 dBi), a unidirectional pattern, and linear polarization. The planar conductor's major dimension has been known to be greater than that required for the antenna of the present invention, for operation at a particular frequency range.

SUMMARY OF THE INVENTION

In view of the above-mentioned limitations of the prior art antennas, it is an object of the present invention to provide an antenna for use with a portable wireless communications device. It is another object of the invention to provide an antenna unit which is lightweight, compact, highly reliable, and efficiently produced.

The present invention replaces the external wire antenna of a wireless communication device with a resonator element which is disposed within the housing of a wireless device and closely-spaced to the printed wiring board (PWB) and signal port of the wireless device. Electrical connection to the wireless device's PWB may be achieved through automated production equipment, resulting in cost effective assembly and production.

It is an object of the present invention to provide an antenna assembly which can resolve the above shortcomings of conventional antennas. Additional objects of the present invention include: the elimination of the external antenna and its attendant faults such as susceptibility to breakage and impact on overall length of the transceiver; the provision of an internal antenna that can easily fit inside the housing of a wireless transceiver such as a cell phone, with minimal impact on its length and volume; the provision of a cost effective antenna for a wireless transceiver, having electrical performance comparable to existing antenna types; and, the reduction in SAR (specific absorption rate) of the antenna assembly, as the antenna exhibits reduced transmit field strength in the direction of the user's ear for hand held transceivers such as a cellular telephone, when compared to the field strength associated with an external wire type antenna system.

Another object of the present invention is the provision of an antenna assembly which is extremely compact in size relative to existing antenna assemblies. The antenna assembly may be incorporated internally within a wireless handset. A unique feed system with a matching component is employed to couple the antenna to the RF port of the wireless device. Beneficially, the antenna assembly may be handled and soldered like any other SMD electronic component. Because the antenna is small, the danger of damage is minimized as there are no external projections out of the WCD's housing. Additionally, portions of the antenna assembly may be disposed away from the printed wiring board and components thereof, allowing components to be disposed between the antenna assembly and the printed wiring board (PWB).

Another object of the present invention is an antenna assembly providing substantially improved electrical performance versus volume ratio, and electrical performance versus cost as compared to known antenna assemblies. In a preferred embodiment, the antenna may exhibit resonant frequency ranges within cell phone and PCS bands, 880–960 MHz and 1710–1880 MHz ranges, respectively.

The present invention provides an antenna having a compact size and able to conform to an available volume in the housing of a wireless transceiver such as a cellular telephone. The antenna assembly may be excited or fed with 50 ohm impedance, which is a known convenient impedance level found at the receiver input/transmitter output of a typical wireless transceiver.

One aspect of the present invention provides an asymmetrical dipole antenna consisting of a planar conductor, a matching network, and a resonator. The antenna is relatively compact in comparison to other antennas having similar operational characteristics. The antenna may operate on one or more frequency bands, and is suitable for high volume production. The antenna exhibits simultaneous dual linear polarizations and a unidirectional pattern in at least one of its operating frequency ranges when configured for multiple-band operation. Applications for the antenna include wireless communication devices such as cellular telephones or data devices.

An object of the present invention is to provide a single or multiple-frequency-band asymmetric dipole antenna employing a small planar conductor.

Another object of the present invention is to provide an ultra-compact asymmetric dipole antenna suitable for use in a wireless communication device.

Another object of the present invention is to provide an ultra-compact asymmetric dipole antenna having a peak gain near that of a dipole antenna.

Yet another object of the present invention is to provide a single or multiple-frequency-band asymmetric dipole antenna exhibiting dual linear polarization within at least one of the frequency bands.

Another object of the present invention is to provide a single or multiple-frequency-band asymmetric dipole antenna exhibiting substantial unidirectivity in at least one frequency band, thereby reducing the specific absorption rate (SAR).

A further object of the present invention is to reduce the size of an asymmetric dipole antenna by employing a resonator closely spaced and generally parallel to a matching network and underlying ground plane.

A further object of the present invention is to provide a reduced-sized asymmetrical dipole antenna containable within the top rear of a wireless communications device, such as a cellular telephone, in order to reduce electrical interference caused by the hand of the user.

Yet a further object of the present invention is to provide a reduced-sized asymmetric dipole antenna having a resonator with sections facilitating multiple frequency band resonance.

Still a further object of the present invention is to provide a reduced-sized asymmetric dipole antenna having a resonator lying in a plane generally parallel to a closely spaced planar matching network and underlying ground plane in which the resonator section includes skirt portions folded toward the matching network.

A still further object of the present invention is to provide a reduced-sized asymmetric dipole antenna having a resonator section lying in a plane generally parallel to a closely spaced planar matching network in which the matching network includes three sections, one of which is a shorted stub and another is a series impedance element.

Yet another object of the present invention is to provide an ultra-compact asymmetrical dipole antenna having a useful impedance match to a nominally 50 ohm unbalanced feed line.

Another object of the present invention is to provide an ultra-compact asymmetrical dipole antenna for use in a wireless communications device having a resonator and a matching network fabricated with printed circuit board elements and a planar conductor (ground plane) constituted by the printed circuit board ground traces of the wireless communications device's electronics.

The above and other objects and advantageous features of the present invention will be made apparent from the following description with reference to the accompanying drawings, in which like reference characters designate the same or similar parts throughout the drawings.

DESCRIPTION OF THE PREFERRED EMBODIMENTS

Figure 1:
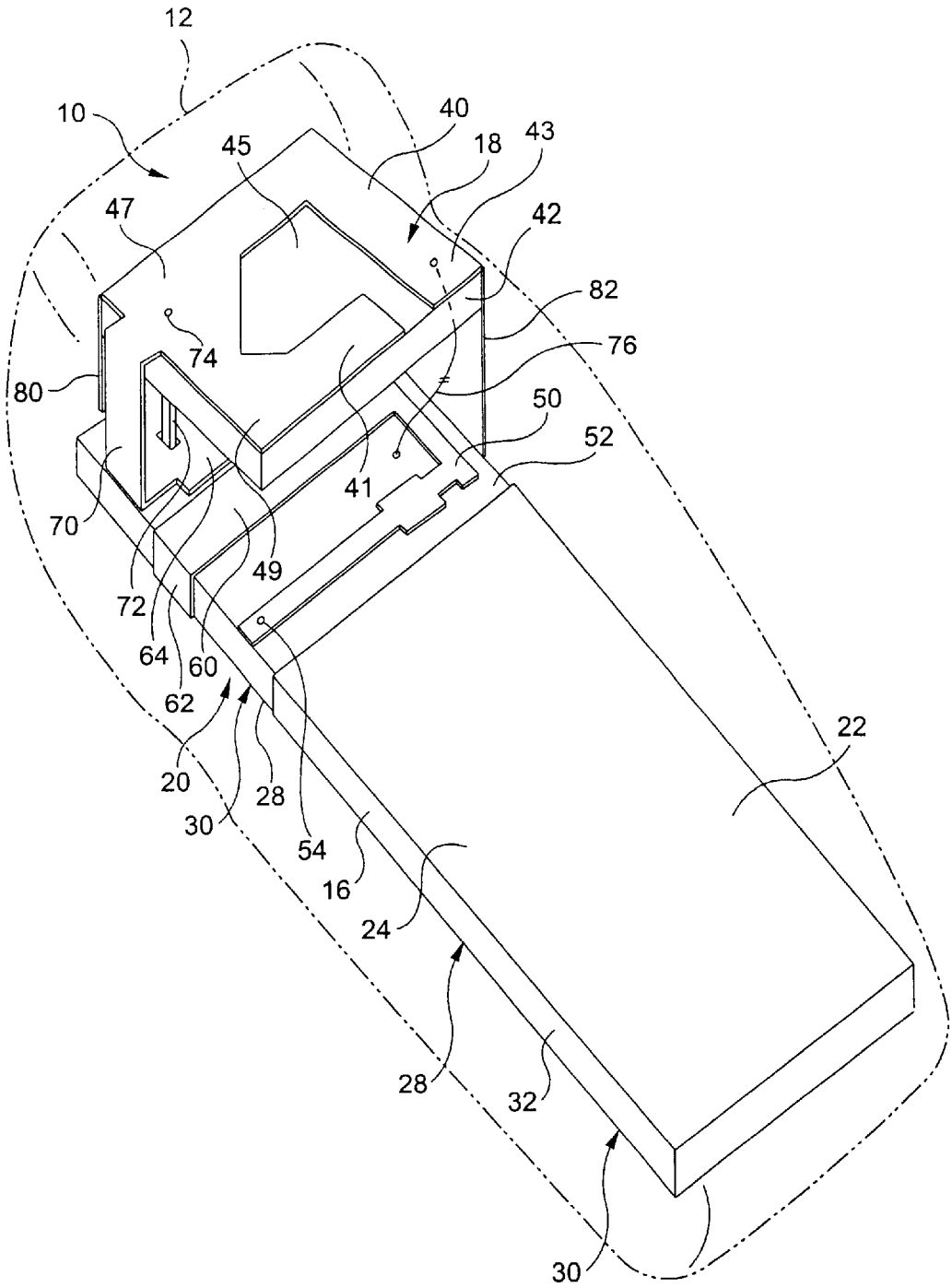
FIG. 1 shows a perspective view of an embodiment of an antenna according to the present invention.

FIG. 1 shows a perspective view of one embodiment of the antenna 10 of the present invention incorporated within the housing 12 of a portable wireless communications device, such as a cellular telephone. The antenna 10 includes a planar conductor or ground plane 16, a resonator element 18, and a matching network 20.

Figure 2:
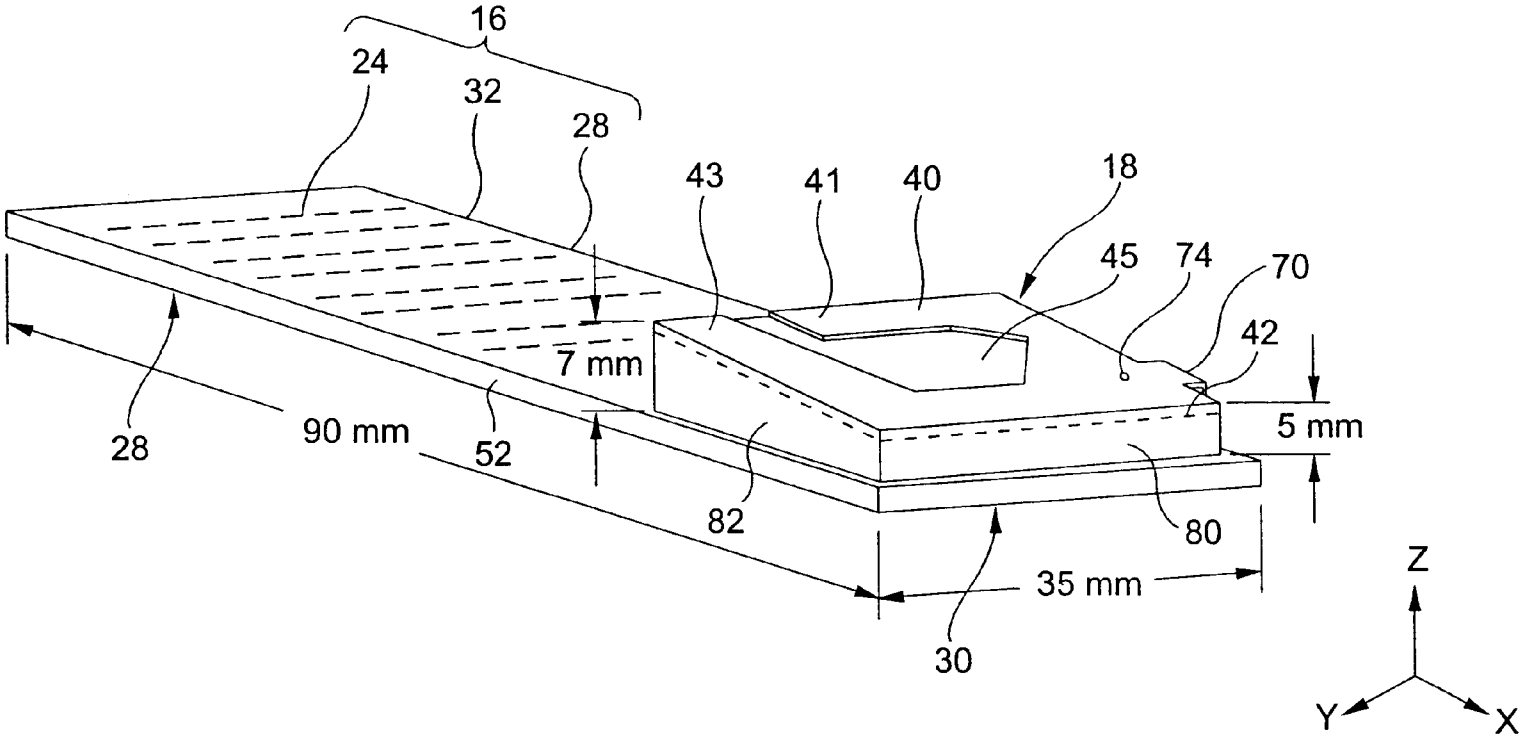
FIG. 2 is a perspective view similar to FIG. 2, adding major dimensions.

Referring to FIG. 1 and 2, the planar conductor 16 may be provided upon a printed wiring board (PWB) 22. Planar ground conductor 16 includes a conducting layer 24 covering a portion of the top major surface (as shown in FIG. 1) of PWB 22 and a conducting layer 28 covering a larger portion of the bottom major surface 30 (including underneath the matching network 20) of PWB 22. Conducting layers 24 and 28 are electrically connected via an edge connection 32. In a practical wireless communication device, the planar conductor 16 may be provided by a double-sided printed circuit board carrying components on one or both surfaces of the board and having ground traces on both sides of the board (the ground traces thus providing the required ground plane). As illustrated, the continuous conductors 24, 28 on both sides of the PWB 22 are electrically connected by a continuous edge connection 32. In alternative configurations, the ground traces provided on opposite sides of the board may be electrically connected by plated-through holes.

Figure 3:
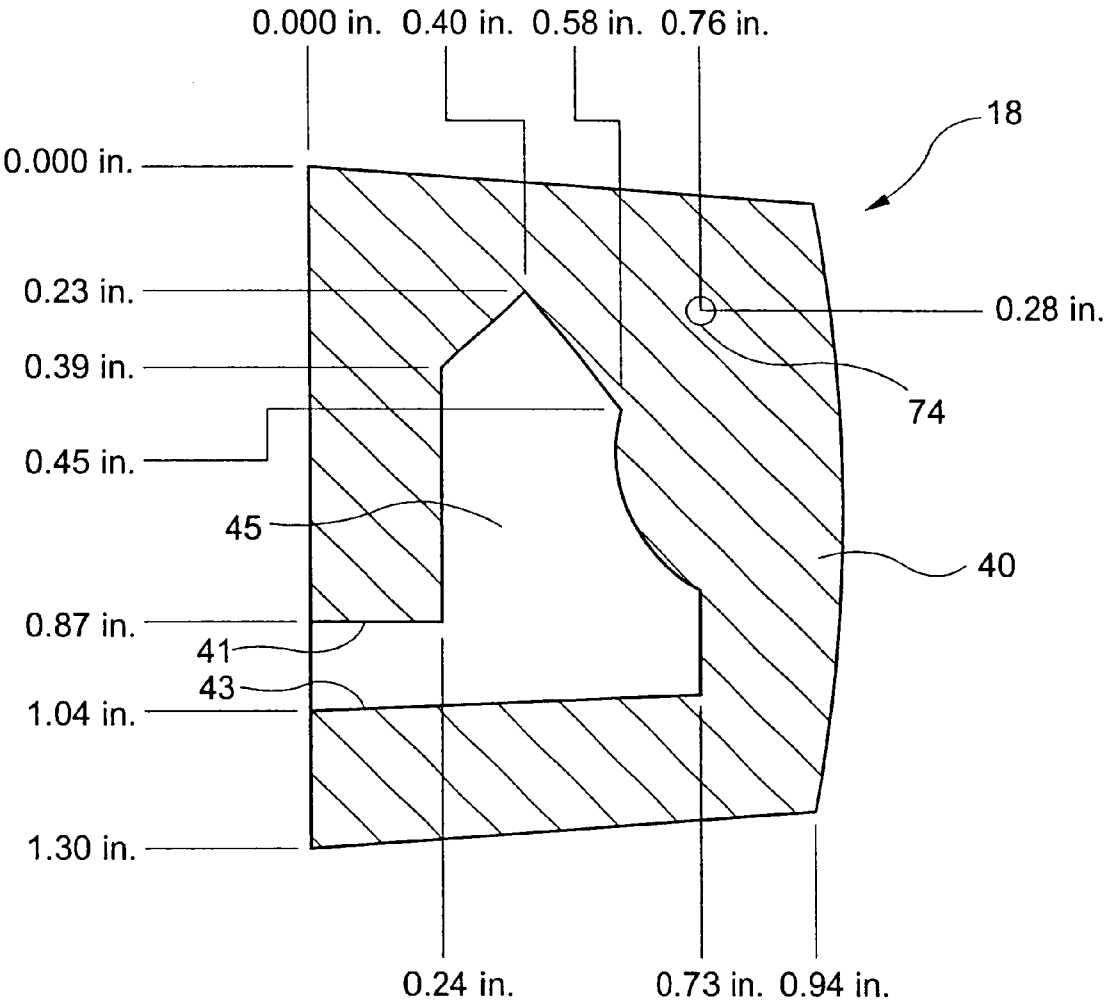
FIG. 3 is a plan view of the serpentine conductor forming a portion of the resonator of the antenna of FIGS. 1–3.

With reference to FIGS. 1–3, the resonator element 18 includes a conductive printed circuit trace 40 on a dielectric substrate 42. FIG. 3 shows a plan view of one embodiment of the resonator element 18. Resonator element 18 includes a serpentine conductor 40 having opened ends 41, 43 and an interior region 45. The conductor 40 includes a portion 47 sized to effectively resonate within the cell band, 880–960 MHz, and a portion 49 sized to effectively resonate within the PCS band, 1710–1880 MHz. The configuration of resonator element 18 and its connections to other portions of the antenna 10 were determined empirically. The conductive trace element 40 may be fabricated of such conductive materials as aluminum, gold, silver, copper and brass or other metals however for most uses of the antenna copper or copper alloyed or plated with another material is to be preferred. According to one aspect of the invention the use of copper along with photographic-based copper removal techniques as are commonly used in the printed circuit art are preferred in fabricating the antenna. In alternative embodiments, the resonator element 18 may be formed from a bent metal stamping, or other discrete metal components as appreciated by those skilled in the relevant arts.

In one practical embodiment, the dielectric constant of the resonator element 18 substrate 42 is approximately 2.3. The substrate 42 may be made from a material such as Duroid®. A material other than this Duroid® may be used as the antenna substrate 42 where differing electrical, physical or chemical properties are needed. Such variation may cause electrical properties to change if not accommodated by compensating changes in other parts of the antenna as will be appreciated by those skilled in the electrical and antenna arts.

Figure 4:
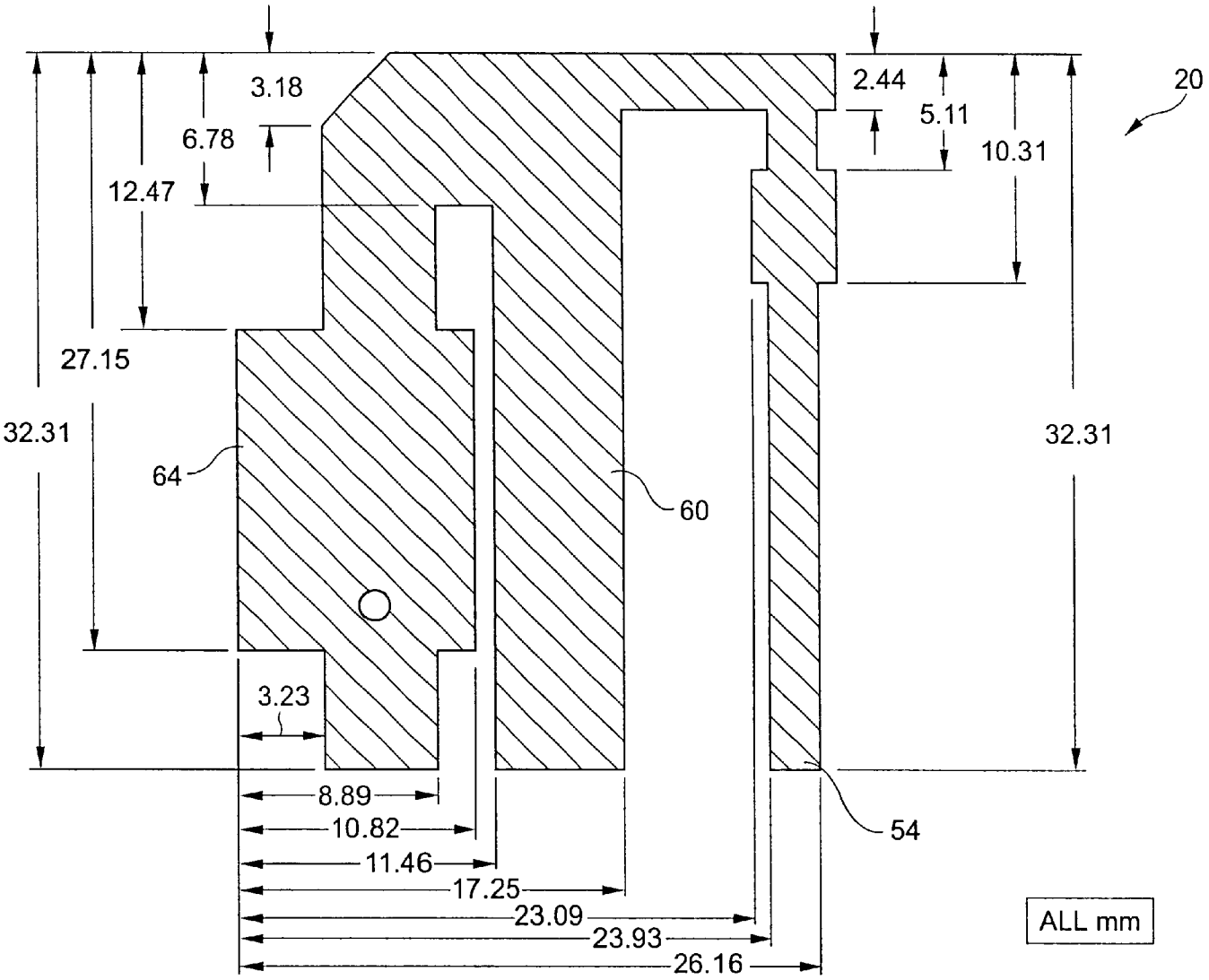
FIG. 4 is a plan view of a three-fingered conductor forming a portion of a matching network of the antenna of FIGS. 1–3.

With reference to FIGS. 1, 2 and 4, matching network 20 includes a printed circuit trace 50 on a dielectric substrate 52. A 50 ohm feedpoint for the antenna 10 is provided at location 54 of matching network 20. The dielectric substrate 52 of the matching network 20 may be a portion of the printed wiring board 22. Alternatively, the dielectric substrate 52 may be a separate element from the printed wiring board 22. The other side of the dielectric substrate 52 includes a continuation of the ground plane conductor layer 28. FIG. 4 shows a plan view of a portion of the three-fingered matching network 20. The matching network 20 includes a central finger 60 connected to the ground plane 16 by conductor 62 (as illustrated in FIG. 1). The configuration of matching network 20 and its connections to other portions of the antenna 10 were determined empirically. The central finger 60 of the matching network 20 is in the nature of a matching stub and the left hand trace 64 is in the nature of a series resonant matching element. Initial values of their reactances were calculated and their final configurations and shapes were optimized empirically.

Referring to FIG. 1, an electrical connection between resonator element 18 and matching network 20 is made by a conductor 70 that may be in the form of a strap or tab. The tab conductor 70 may be soldered between the conductive trace 40 of the resonator element 18 and the conductive trace 50 of the matching network 20. An electrical connection between resonator element 18 and the ground plane (planar conductor 16) is made by conductor 72. Conductor 72 is connected to the conductive trace 40 at location 74 and passes through the dielectric substrate 42 of the resonator element 18. Conductor 72 passes through, but is electrically insulated from, the conductive trace 50 of the matching network 20. FIG. 1 illustrates an optional tuning capacitor 76 connected between end 43 of the conductive trace 40 and the ground plane 28. The optional tuning capacitor 76 may be a discrete capacitor, or other known capacitive tuning structures.

Referring to FIGS. 1 and 2, skirt portions 80, 82 are provided along two edges of resonator element 18. The skirt portions 80, 82 function to lower the resonant frequency of the conductive resonator element 18. The skirt portions 80, 82 are conductive elements connected to the conductive trace element 40 of the resonator 18 and extend toward the printed wiring board 22 and matching network 20 to within about 1.5 millimeters of the top surface of the matching network 20. The skirt portions 80, 82 are not in electrical contact with the matching network 20.

Referring to FIG. 2, major dimensions are shown for the heights of resonator element 18 above matching network 20 in a practical embodiment of the invention. The dimensions shown in this and other figures are suitable for operation in the frequency ranges 880–960 MHz and 1710–1880 MHz. Although the plane of resonator element 18 is generally parallel to the plane of matching network 20 and PWB 22, the resonator element 18 of the practical embodiment shown is slightly tilted. Such a tilt may be useful to fit the antenna 10 within the housing 12 of a particular wireless device.

The dimensions shown in FIGS. 2–4 all may have a range of values, however, they are interactive (i.e., changing one dimension is likely to require changing one or more other dimensions) and changes in them affects frequency range, input impedance and antenna pattern, as one skilled in the art would recognize.

Figure 5:
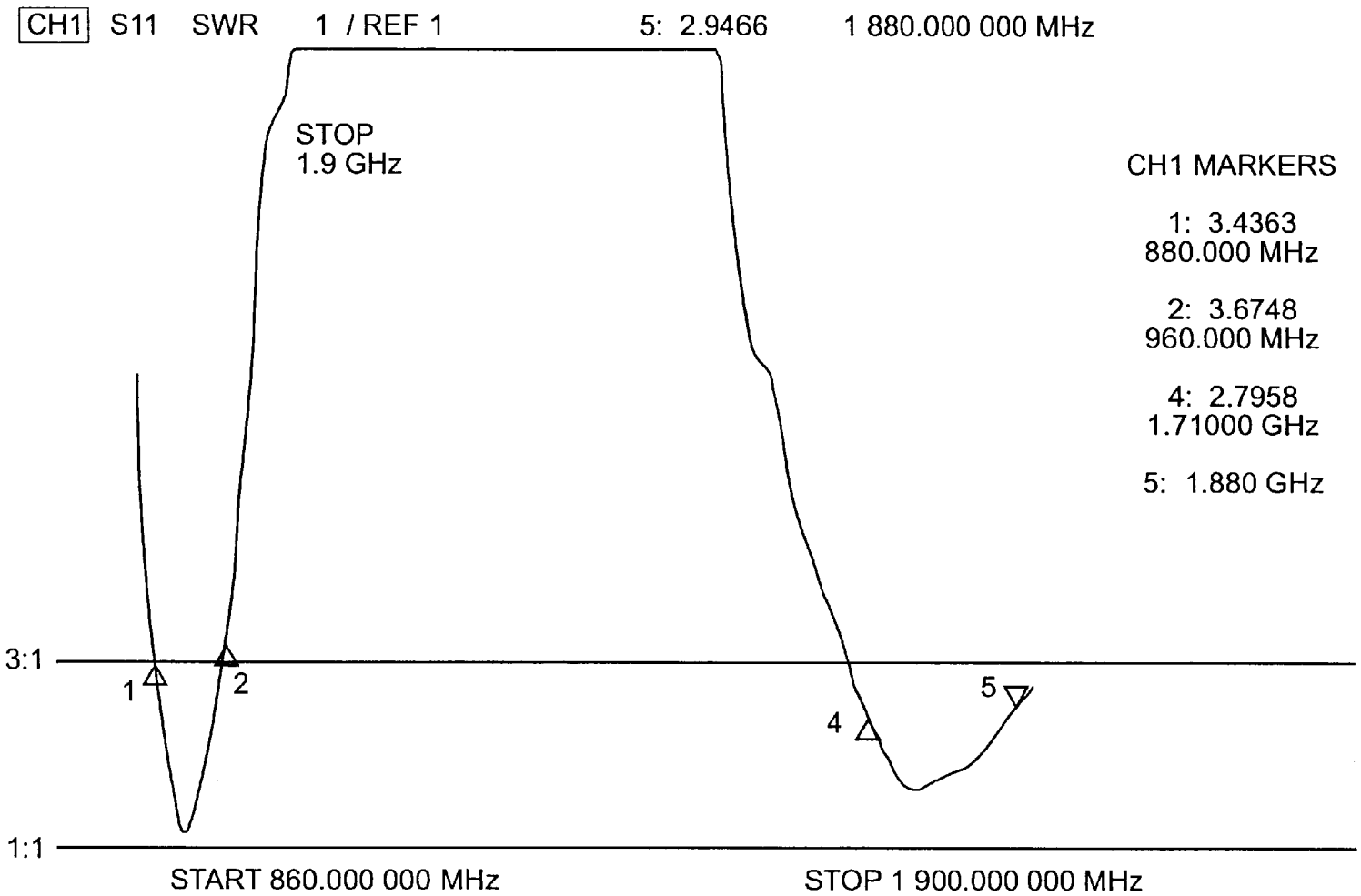
FIG. 5 is a plot of voltage standing wave ratio (VSWR) versus frequency for the antenna of FIGS. 1–5, for a 50 ohm measurement system.

FIG. 5 shows a plot of voltage standing wave ratio (VSWR) versus frequency for antenna 10 for a 50 ohm measurement system, illustrating particularly applicability of the antenna 10 over two frequency bands of operation, e.g., 880–960 MHz and 1.71 and 1.88 GHz.

Figure 6:
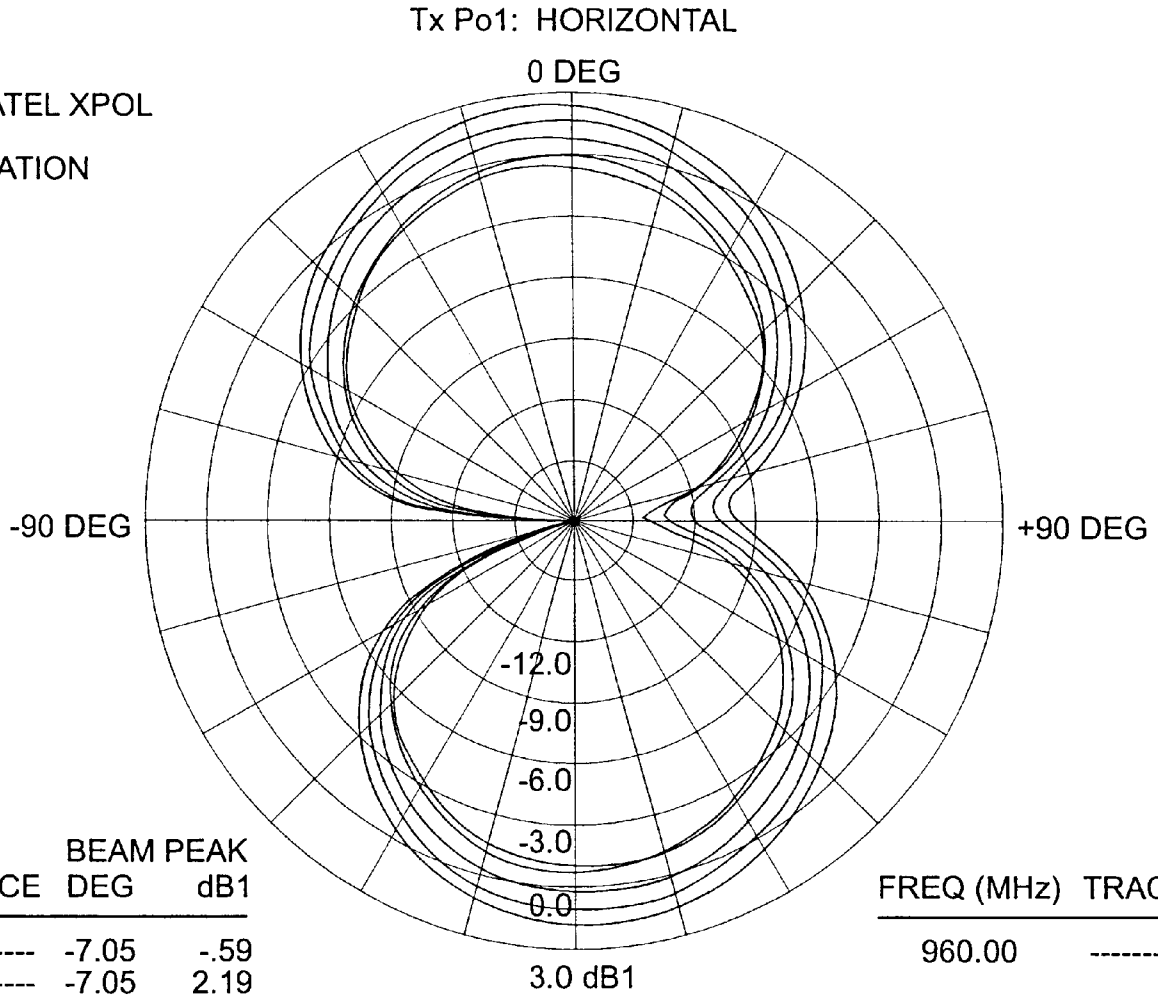
FIG. 6 shows an azimuthal antenna pattern for an antenna according to FIGS. 1–5 at frequencies in a first frequency band for the case of a horizontally polarized range antenna.

FIG. 6 shows an azimuthal antenna pattern for antenna 10 at frequencies in the 880–960 MHz range, for a horizontally polarized range antenna and for antenna 10 oriented with its major dimensions parallel to the x-y plane of FIG. 2, and rotation about the z-axis, with the z-direction toward the range antenna and 0 degrees on the plot also along the z-axis. The shorter major dimension of antenna 10 is parallel to the z-axis. Gain values are listed in the table within the figure.

Figure 7:
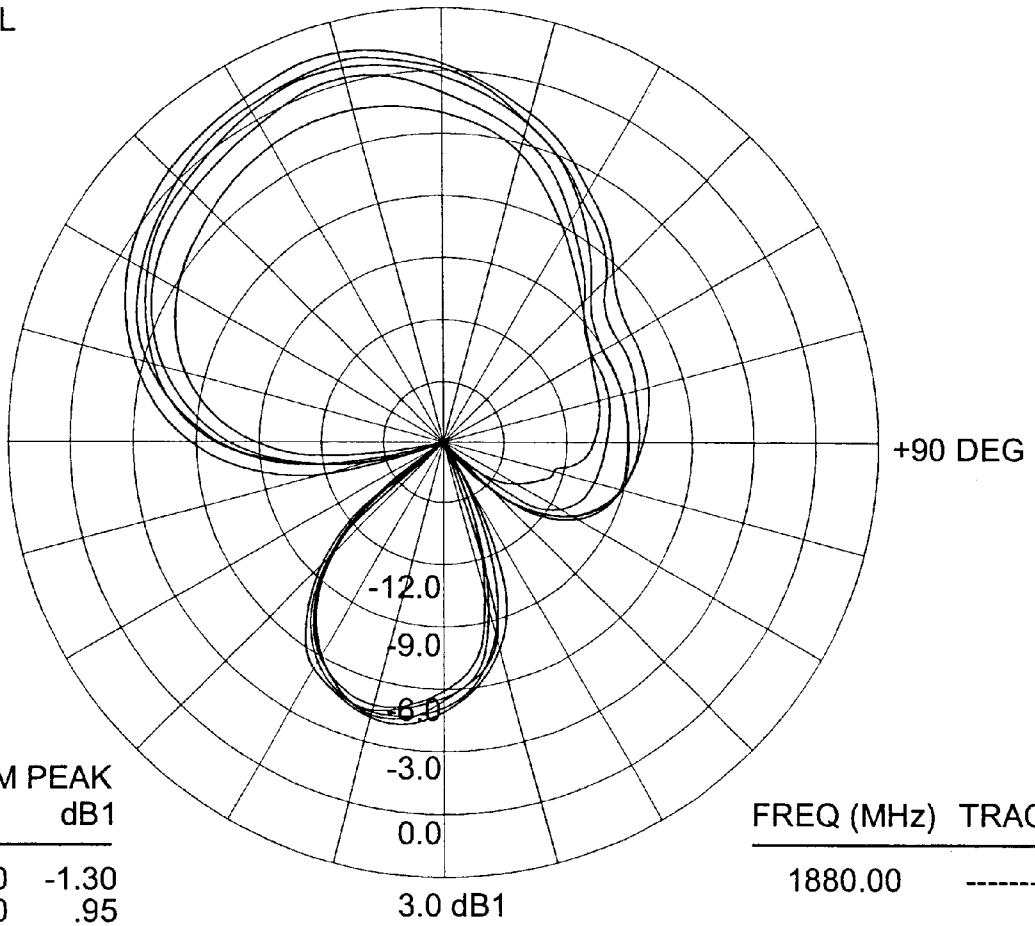
FIG. 7 shows an azimuthal antenna pattern for an antenna according to FIGS. 1–5 at frequencies in a second frequency band for the case of a horizontally polarized range antenna.

FIG. 7 shows an azimuth pattern for identical test conditions as in FIG. 6, except that the frequency range is 1710–1880 MHz.

Figure 8:
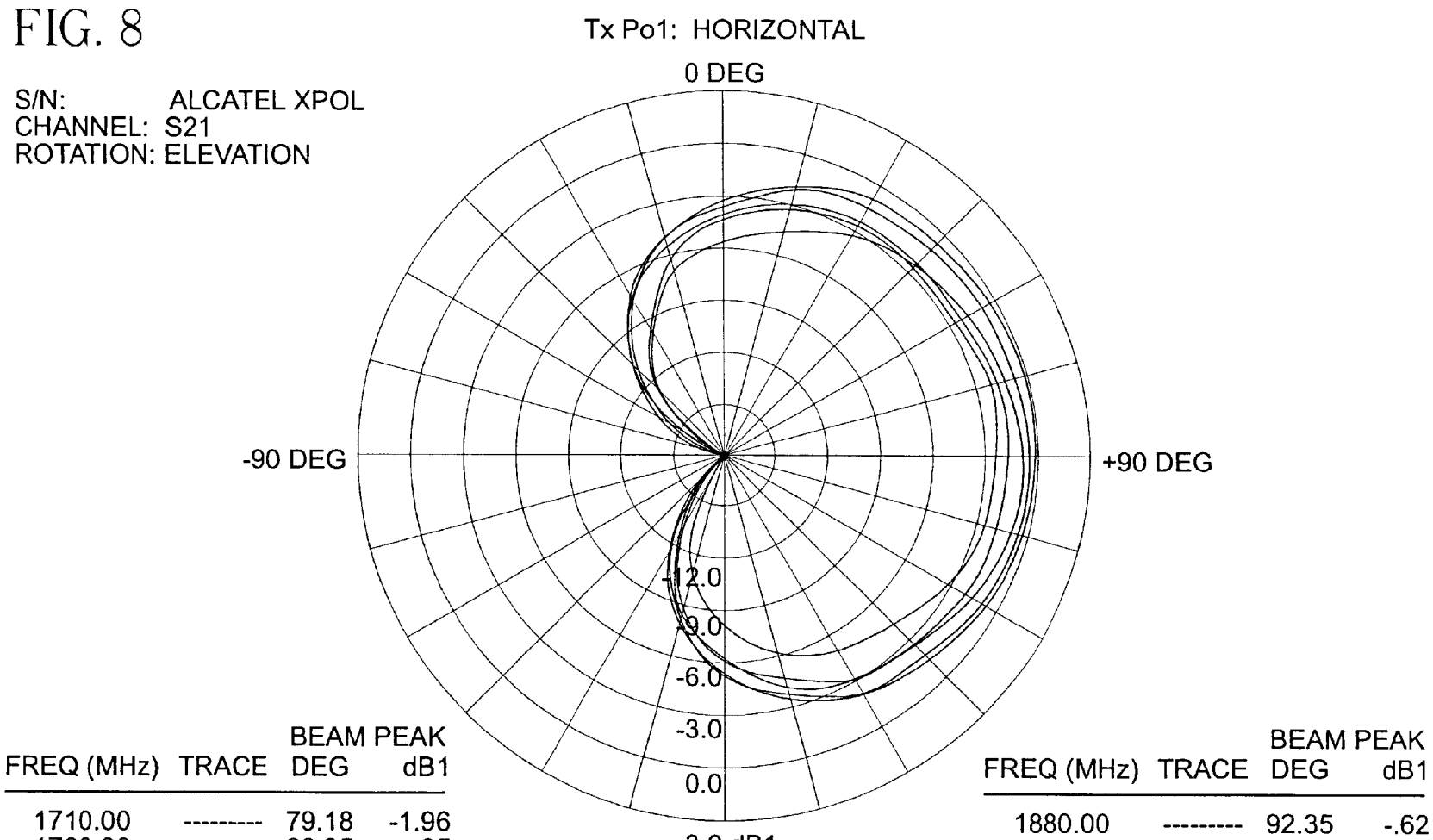
FIG. 8 shows an azimuthal antenna pattern for an antenna according to FIGS. 1–5 at frequencies in a second frequency band for the case of a vertically polarized range antenna.

FIG. 8 shows an azimuth pattern for identical test conditions as in FIG. 7, except the range antenna is vertically polarized. Gain values are listed in the table within the figure.

Additional advantages and modification will readily occur to those skilled in the art. The invention in its broader aspects is, therefore, not limited to the specific details, representative apparatus and illustrative examples shown and described. Accordingly, departures from such details may be made without departing from the spirit or scope of the applicant's general inventive concept.

What is claimed is:

1. An antenna assembly for use in a wireless communications device having a ground plane and a signal port, the antenna assembly comprising:

a matching network having a plurality of separate conductive sections, including a first conductive section defining a feed point connected to the signal port, and a second conductive section connected to the ground plane;

an open-ended dual frequency conductive resonator element having a first region sized to effectively resonate over a first predetermined frequency band and a second region sized to effectively resonate over a second predetermined frequency band, said resonator element being disposed a predetermined distance away from the ground plane, and a plurality of conductive connection elements, including at least a first connection element connected between the matching network and the resonator element, and a second connection element connected between the resonator element and the ground plane.

2. An antenna according to claim 1, wherein the conductive matching network and resonator element are generally planar.

3. An antenna according to claim 1, wherein the conductive matching network includes a plurality of generally elongated finger portions.

4. An antenna according to claim 1, wherein the resonator element is disposed upon a surface of a dielectric substrate element.

5. An antenna according to claim 4, wherein the resonator element is a conductive plating disposed upon the surface of the dielectric substrate element.

6. An antenna according to claim 1, further comprising:

a capacitive tuning element coupled between the resonator element and the ground plane.

7. An antenna according to claim 1, further comprising:

a conductive skirt element coupled to the resonator element and extending toward the ground plane.

8. An antenna according to claim 1, wherein the first region is sized to effectively resonate over the 880–960 MHz frequency band and a second region is sized to effectively resonate over the 1710–1880 MHz frequency band.

9. An antenna according to claim 1, wherein the resonator element includes a conductive trace element having a pair of generally opposed ends and an interior region.

10. An antenna assembly for use in a wireless communications device, the antenna assembly comprising:

a conductive ground plane defined upon a surface of a first dielectric board element;

a matching network defined upon a surface of the first dielectric board element, said matching network having a plurality of separate conductive sections including a first conductive section defining a feed point connected to the signal port, and a second conductive section connecting to the ground plane;

an open-ended dual frequency conductive resonator element defined upon a surface of a second dielectric board element, said resonator element having a first region sized to effectively resonate over a first predetermined frequency band and a second region sized to effectively resonate over a second predetermined frequency band, said resonator element being disposed a predetermined distance away from the ground plane, and a plurality of conductive connection elements, including at least a first conductive connection element connected between the matching network and the resonator element, and a second conductive connection element connected between the resonator element and the ground plane.

11. An antenna according to claim 10, wherein the conductive matching network includes a plurality of generally elongated finger portions.

12. An antenna according to claim 10, wherein the resonator element is a conductive plating disposed upon the surface of the first dielectric board element.

13. An antenna according to claim 10, further comprising:

a capacitive tuning element coupled between the resonator element and the ground plane.

14. An antenna according to claim 10, further comprising:

a conductive skirt element coupled to the resonator element and extending toward the ground plane.

15. An antenna according to claim 10, wherein the first region is sized to effectively resonate over the 880–960 MHz frequency band and a second region is sized to effectively resonate over the 1710–1880 MHz frequency band.

16. An antenna according to claim 10, wherein the resonator element includes a conductive trace element having a pair of generally opposed ends and an interior region.

17. An antenna assembly for use in a wireless communications device, the antenna assembly comprising:

a dielectric board element having a plurality of electronic components disposed thereupon;

a ground plane disposed upon the dielectric board element;

a conductive matching network disposed upon a surface of the dielectric board element, said matching network having a plurality of separate conductive sections including a first conductive section defining a feed point connected to the signal port, a second conductive section connecting to the ground plane, and a conductive third section;

an open-ended dual frequency conductive resonator element disposed upon a surface of a second dielectric board element, said resonator element having a first region sized to effectively resonate over a first predetermined frequency band and a second region sized to effectively resonate over a second predetermined frequency band, said resonator element being disposed a predetermined distance away from the ground plane, and a plurality of conductive connection elements, including at least a first conductive connection element connected between the matching network and the dual frequency conductive element, and a second conductive connection element connected between the dual frequency conductive element and the ground plane.

18. An antenna according to claim 17, wherein the conductive matching network includes a plurality of generally elongated finger portions.

19. An antenna according to claim 17, wherein the resonator element is a conductive plating disposed upon the surface of the second dielectric board element.

20. An antenna according to claim 17, further comprising:

a capacitive tuning element coupled between the resonator element and the ground plane.

21. An antenna according to claim 17, further comprising:

a conductive skirt element coupled to the resonator element and extending toward the ground plane.

22. An antenna according to claim 17, wherein the first region is sized to effectively resonate over the 880–960 MHz frequency band and a second region is sized to effectively resonate over the 1710–1880 MHz frequency band.

23. An antenna according to claim 17, wherein the resonator element includes a conductive trace element having a pair of generally opposed ends and an interior region.

* * * * *